US007930831B2

(12) United States Patent
Lin

(10) Patent No.: US 7,930,831 B2
(45) Date of Patent: Apr. 26, 2011

(54) SCRAPER BLADE ASSEMBLY STRUCTURE

(76) Inventor: Wen-Chen Lin, Taichung (TW)

( * ) Notice: Subject to any disclaimer, the term of this patent is extended or adjusted under 35 U.S.C. 154(b) by 300 days.

(21) Appl. No.: 12/187,012

(22) Filed: Aug. 6, 2008

(65) Prior Publication Data

US 2010/0031513 A1 Feb. 11, 2010

(51) Int. Cl.
*B26B 3/00* (2006.01)

(52) U.S. Cl. ..... 30/169; 30/330; 30/349

(58) Field of Classification Search ..... 30/169, 30/349, 357, 342, 333, 330, 331; 15/236.05
See application file for complete search history.

(56) References Cited

U.S. PATENT DOCUMENTS 4,381,604 A * 5/1983 Horst ..... 30/169
4,542,554 A * 9/1985 Wallerstein ..... 15/236.02
4,575,936 A * 3/1986 Gringer ..... 30/169
4,704,795 A * 11/1987 Primich ..... 30/169
4,955,138 A * 9/1990 Henke et al. ..... 30/169
D320,921 S * 10/1991 Henke et al. ..... D8/98
RE34,979 E * 6/1995 Gringer ..... 30/169
5,996,231 A * 12/1999 Roche et al. ..... 30/169
6,085,424 A * 7/2000 Mai ..... 30/169
6,237,225 B1 * 5/2001 Tarrant ..... 30/169
6,519,801 B1 * 2/2003 Chao ..... 15/236.01
6,715,210 B2 * 4/2004 Chao ..... 30/169
7,028,584 B1 * 4/2006 Gracy ..... 81/45
7,293,361 B1 * 11/2007 Miller ..... 30/164.6

* cited by examiner

*Primary Examiner* — Boyer D Ashley
*Assistant Examiner* — Omar Flores-Sánchez
(74) *Attorney, Agent, or Firm* — Rabin & Berdo, P.C.

(57) ABSTRACT

The invention relates to a scraper blade assembly structure. The scraper includes a stem for hand grip and a scraping section in the front. The scraping section includes a jaw plate, a blade and a fastening button. The jaw plate extends backward to form an arm. The jaw plate is attached to the inside of the jaw plate groove of the scraping section by a fastener that also serves as a lever pivot for swinging back and forth. When a fastening button goes into the inside of the jaw plate of the scraping section, it pushes the inner side of the arm of the jaw plate, and so as to generate a great holding power for the front of the jaw plate. Further, the fastening button can be a handle protruding from one side of the scraping section.

3 Claims, 8 Drawing Sheets

SCRAPER BLADE ASSEMBLY STRUCTURE

BACKGROUND OF THE INVENTION

1. Field of the Invention

The invention relates to a tool to remove surface residues in a remodeling project, especially for a scraper blade assembly structure. It is mainly to provide fast replacement for blade, firm assembly and a front stem for strong grip for effective stripping.

2. Description of the Prior Art

To assure the flatness in replacing wallpaper or carpet, it is necessary to remove the surface adhesive residue first. FIG. 1 and FIG. 2 show the structural disassembly diagram and assembly diagram for a known scraper. The scraper comprises a stem 10 for grip and a scraping section 11 at the front end. The back end of the scraping section 11 forms a connecting section 12 that can connect with the stem 10. At the front end there is a jaw 13 and a blade base 14 to accommodate a jaw plate 15 and a blade 16 in assembly. Through screws 17 tightening the jaw plate 15 and the scraping section 11, the jaw plate 15 in the jaw 13 squeezes the blade 16 and therefore the blade 16 can be assembled into the blade base 14 in the scraping section 11. To facilitate the replacement of wallpaper or carpet, a user can use the blade 16 to remove the surface residues by grasping the stem 10 with two hands and exerting force. Further investigation into the above unknown scraper structure reveals the following drawbacks for the blade assembly.

First, the jaw plate 15 provides tightening on the jaw 13 in the scraping section 11 through the screws 17 passing the jaw plate 15 and the scraping section 11. To obtain even tightening, there have to be at least three passing screws 17. In consequence, loosening three screws 17 during replacing the blade 16 causes some inconvenience.

Second, the jaw plate 15 provides tightening for the blade 16 through passing screws 17. But the location of the blade 16 deviates from the vertical direction of force by the screws 17. In consequence, the tightening force to the blade 16 becomes insufficient. When the blade 16 is being used for scraping, it is subject to impact from the force in the opposite direction. There is a risk of loose assembly and detachment.

Third, when a user is scraping surface residues with the blade 16 in the scraping section 11 by grasping the stem with two hands, the angle between the scraping section 11 and the surface is very small. The hand grasping the front end of the stem 10 is very close to the surface, and therefore there is a risk of hurting the fingers of that hand.

The invention is to improve the above drawbacks for scraper blade assembly, which is also the motivation.

SUMMARY OF THE INVENTION

The objective for the invention is to provide a scraper blade assembly structure. It mainly comprises a jaw plate that extends backward to form an arm and a scraping section that has a jaw plate groove to accommodate the jaw plate by a fastener, which also serves as a lever pivot. When fastening buttons are placed into the jaw plate groove in the scraping section, they are sleeved with spring to provide pushing force against the arm, and therefore the front end of the jaw plate can exert a great force to the blade. In this way, a fast replacement and firm assembly for scraper blade is achievable.

Another objective for the invention is to provide a scraper blade assembly structure that the fastening buttons in the jaw plate in the scraping section further become protruding spheres on the side of the scraping section to facilitate strong hand grasping for effective scraping.

To achieve the above objective, the scraper blade assembly structure in the invention mainly comprises a jaw plate that extends backward to form an arm to combine with the jaw plate groove of the scraping section by a fastener that also serves as a lever pivot. The arm can swing back and forth inside the jaw plate groove. The scraping section uses its terminal connecting section to connect with the stem. On one side of the scraping section, there is a jaw plate groove to accommodate the jaw plate. When the fastening button is placed inside the jaw plate groove of the scraping section, it is sleeved with a spring to provide pushing force against the arm, and therefore the front end of the jaw plate can tightly hold the plate in position with the blade base in the front of the jaw plate groove. By turning the fastening button to push against the arm, the front end of the jaw plate generates an extremely strong hold of the blade. On the other hand, by turning the fastening button to release the hold, fast replacement and firm assembly for the blade are achievable.

DETAILED DESCRIPTION OF THE PREFERRED EMBODIMENT

Figure 1:
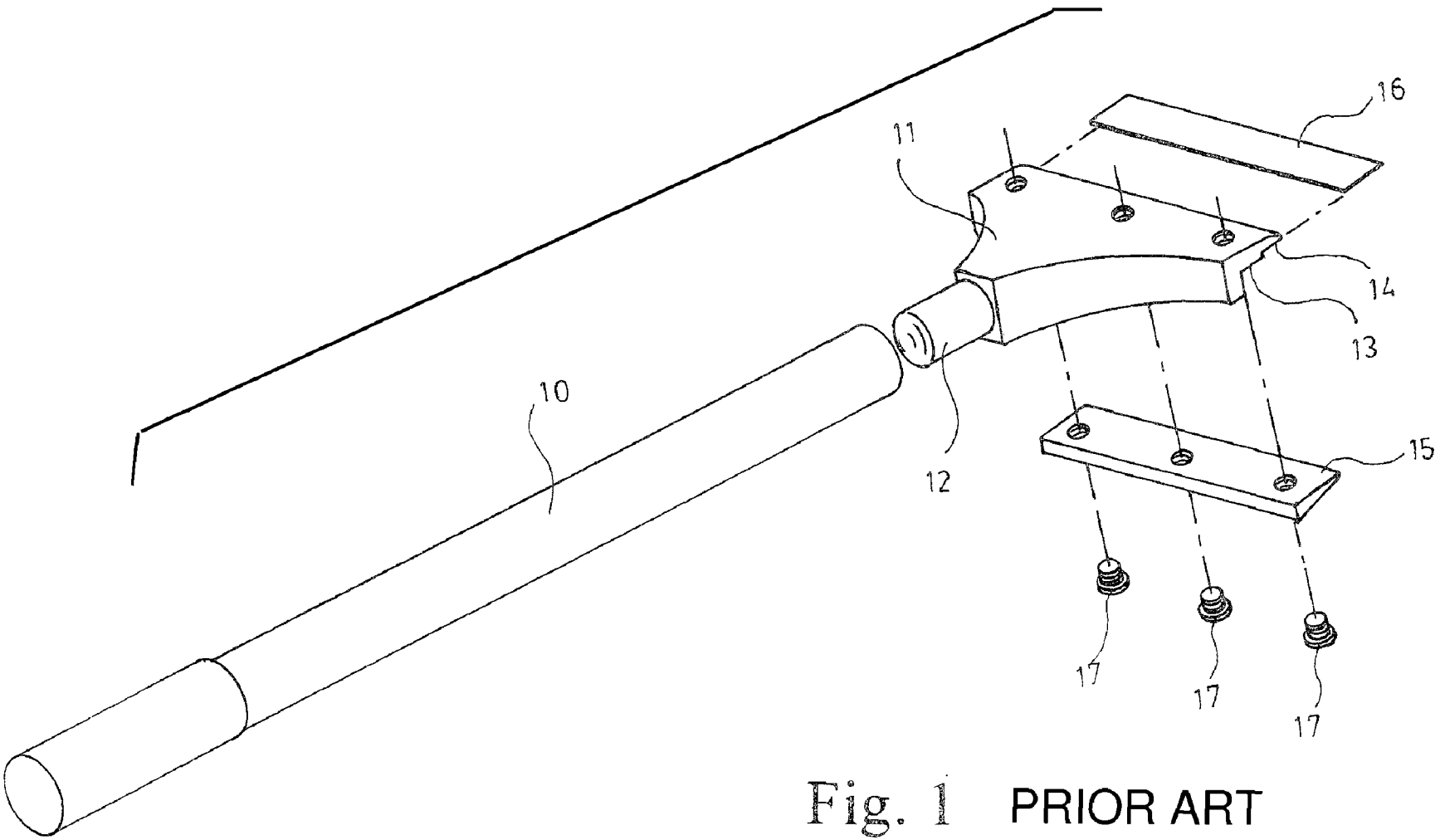
Fig. 1 PRIOR ART
FIG. 1 is a structure disassembly diagram for a common scraper.
Figure 2:
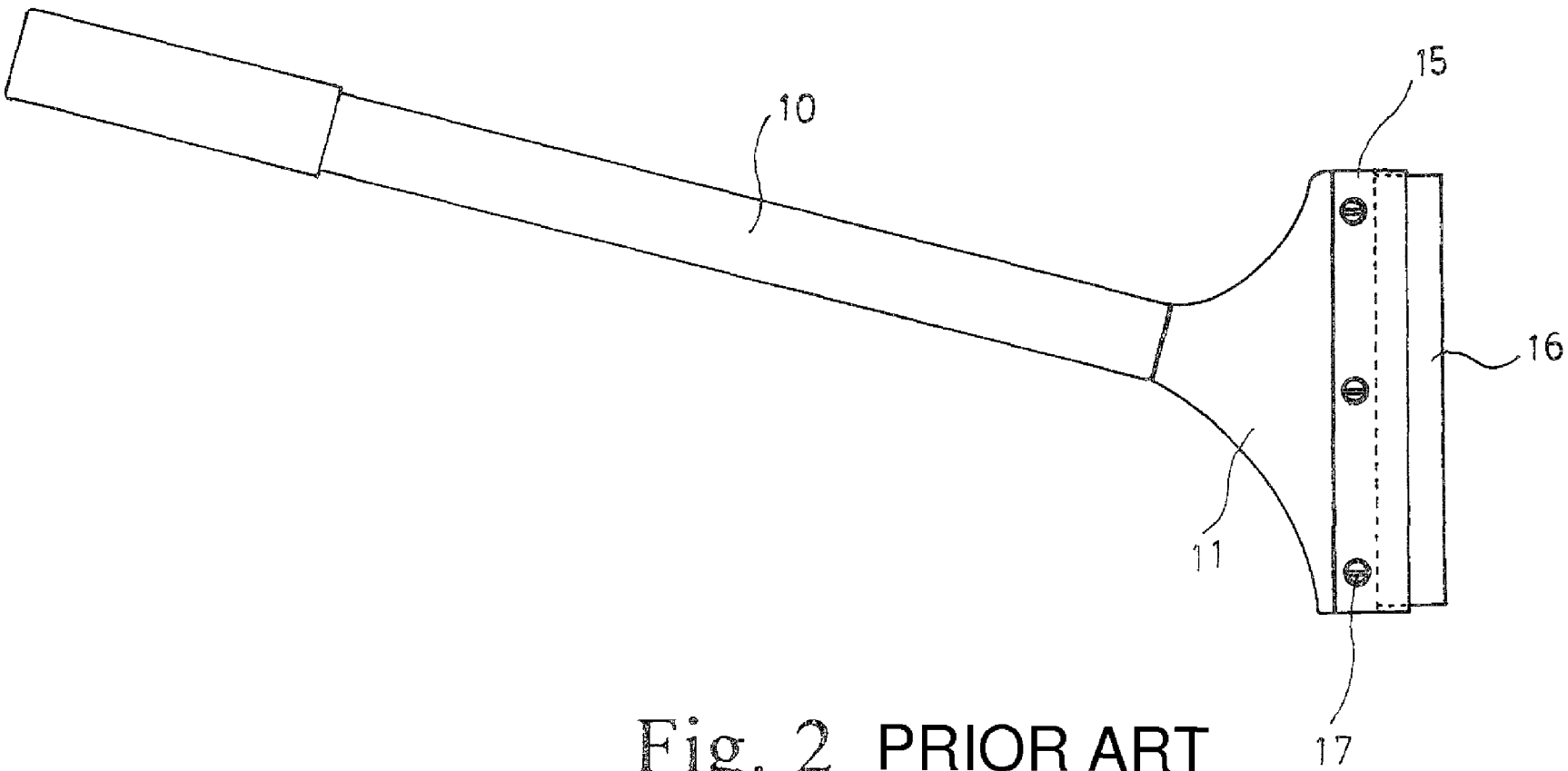
Fig. 2 PRIOR ART
FIG. 2 is an exterior assembly diagram for a common scraper.
Figure 3:
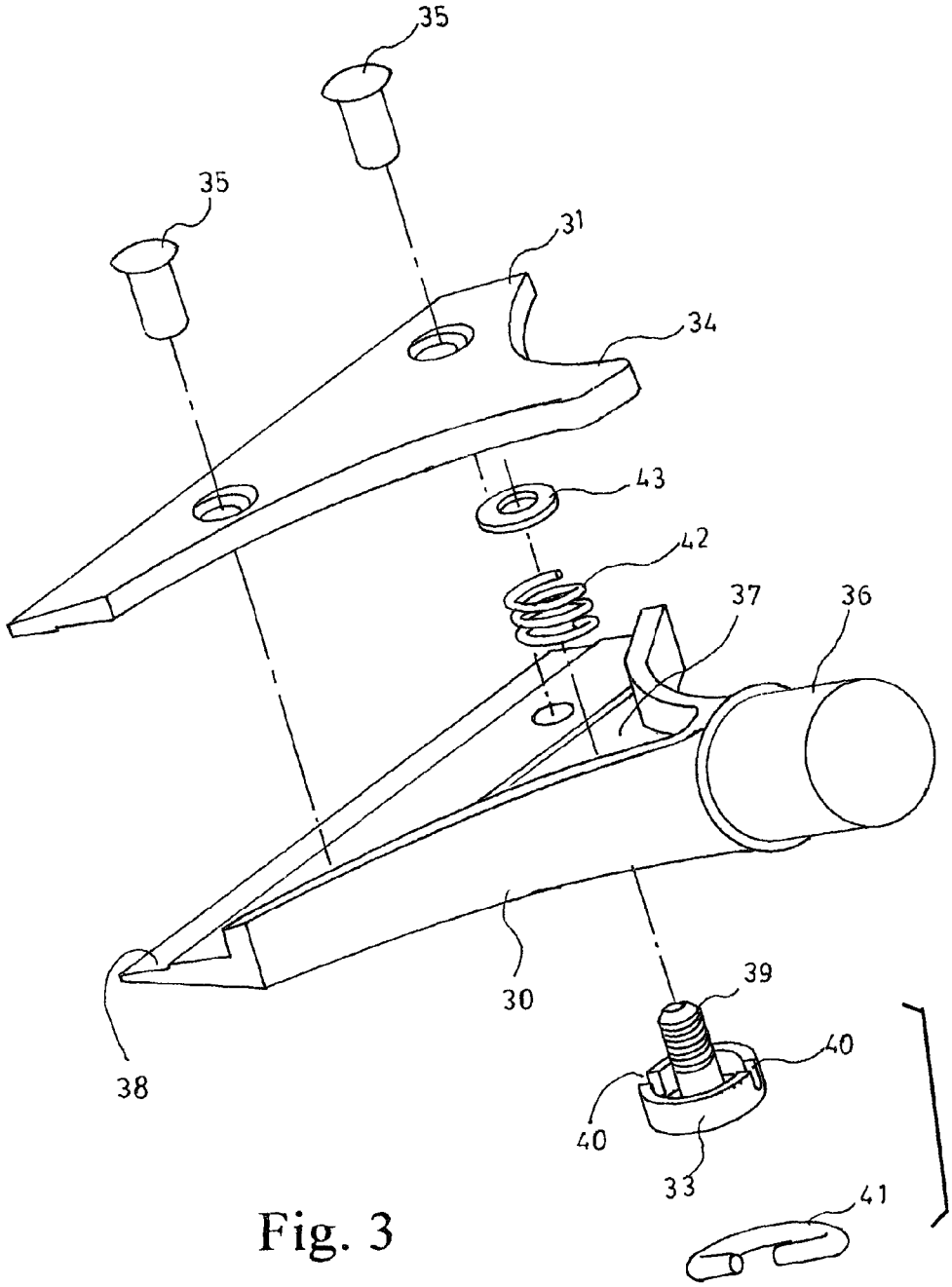
FIG. 3 is a structure disassembly diagram for the scraper blade assembly for the invention.
Figure 4:
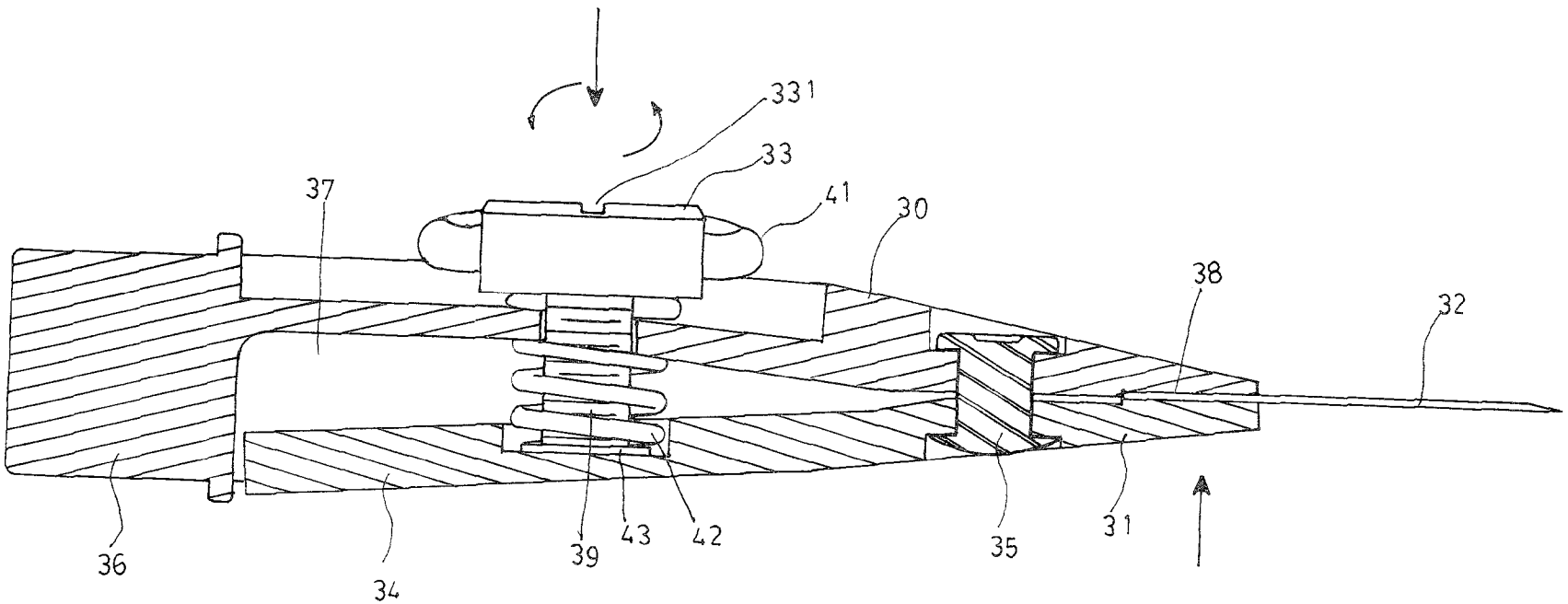
FIG. 4 is a cross-sectional diagram for the scraper blade assembly for the invention.
Figure 5:
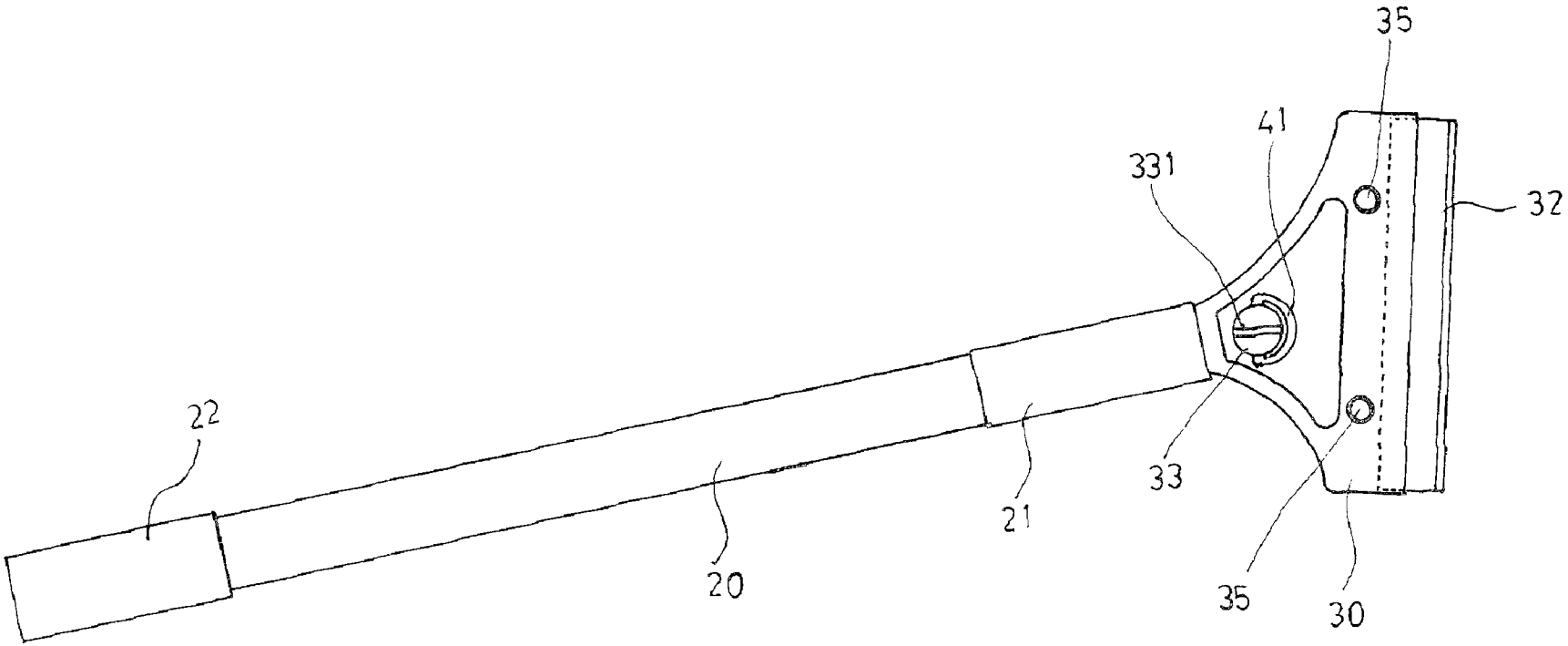
FIG. 5 is an exterior view diagram for the scraper blade assembly for the invention.
Figure 6:
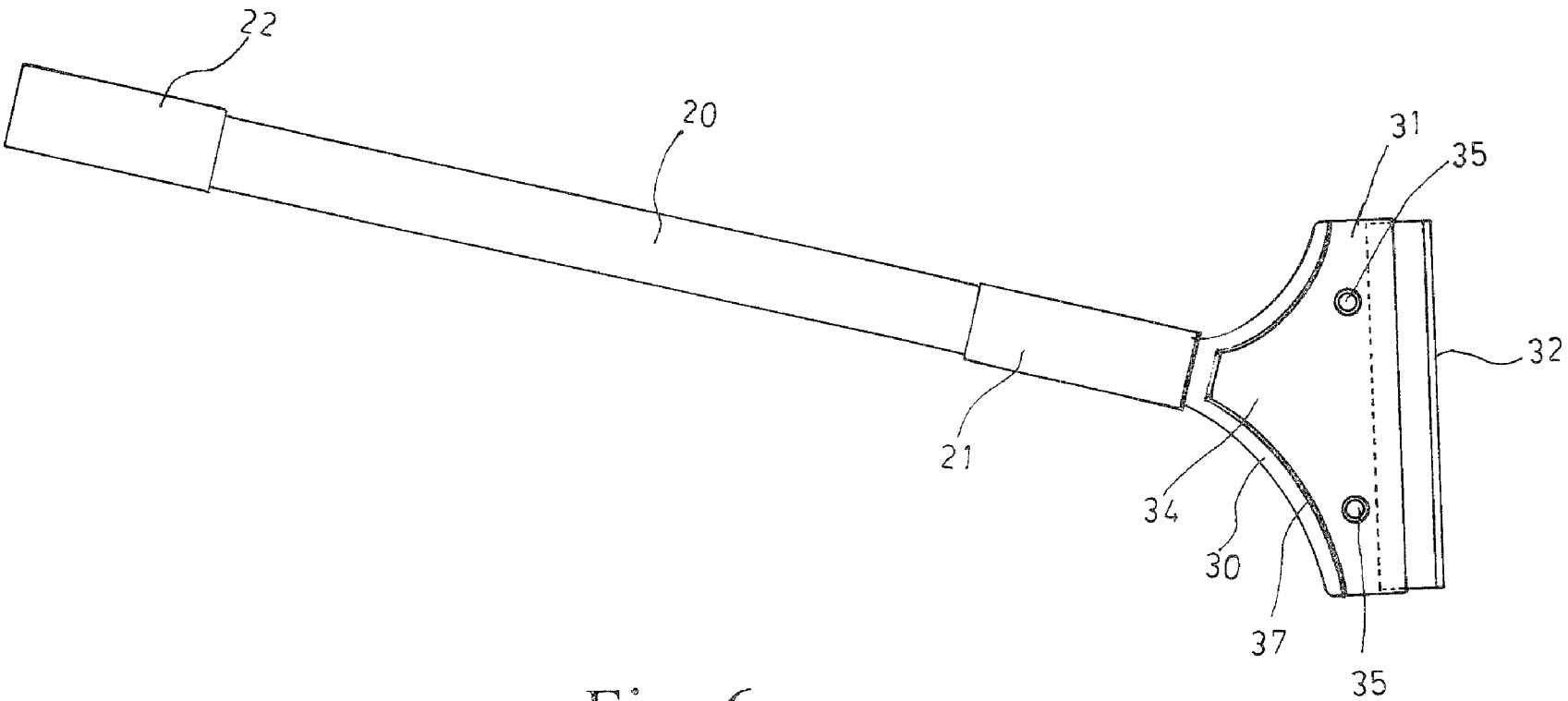
FIG. 6 is another exterior view diagram for the scraper blade assembly for the invention.

A preferred embodiment is provided in the following to describe the features of the invention.

Please refer to FIGS. 3, 4, 5 and 6 for the disassembly diagram, assembly diagram and exterior diagram for the scraper blade assembly structure in the invention. In general the scraper is similar to the known types. It comprises a stem 20 for hand grip and a scraping section in the front. The front end and the back end for the stem 20 are sleeved with a handle 21, 22 for each, so the user can grasp between the front and the back handles 21, 22. The scraping section comprises a lower jaw plate 30, an upper jaw plate 31, a blade 32 and a fastening button 33. The upper jaw plate 31 extends backward to form an arm 34, and is attached by two fasteners 35 to the jaw plate groove 37 of the lower jaw plate 30, and is able to swing back and forth inside the jaw plate groove 37 by using the two fasteners 35 as lever pivot. The lower jaw plate 30 has its terminal connecting section 36 inserted by the stem 20 to become assembled. On one side of the lower jaw plate 30 there is a jaw plate groove 37 that fits and accommodates the upper jaw plate 31. In the front of the jaw plate groove 37 there is a blade base 38. The fastening button 33 has a threaded section 39 in the front and a corresponding notch 40 on each side to accommodate a switch button 41. When the fastening button 33 is attached inside the jaw plate groove 37 of the lower jaw plate 30 by the threaded section 39, it is sleeved with a spring 42 and a stopper 43. The spring 42 provides tension to the inner side of the arm 34 of the upper jaw plate 31. Thus, the front of the upper jaw plate 31 can work with the blade base 38 in the front of the jaw plate groove 37 to hold tightly the blade 32 in position for assembly. By turning the fastening button 33 and pushing the stopper 43 against the arm 34 in the end of the upper jaw plate 31, a strong holding power is generated in the front of the upper jaw plate 31 and exerted to the blade 32. Thus, a firm blade 32 assembly is provided. On the other hand, by turning the fastening button 33 to loosen the holding power in the front of the upper jaw plate 31, the retrieval or replacement for the blade 32 is made easy and fast. A slot 331 made on the top surface of the fastening button 33 is mainly to facilitate its turning by a tool or the switch button 41.

Figure 7:
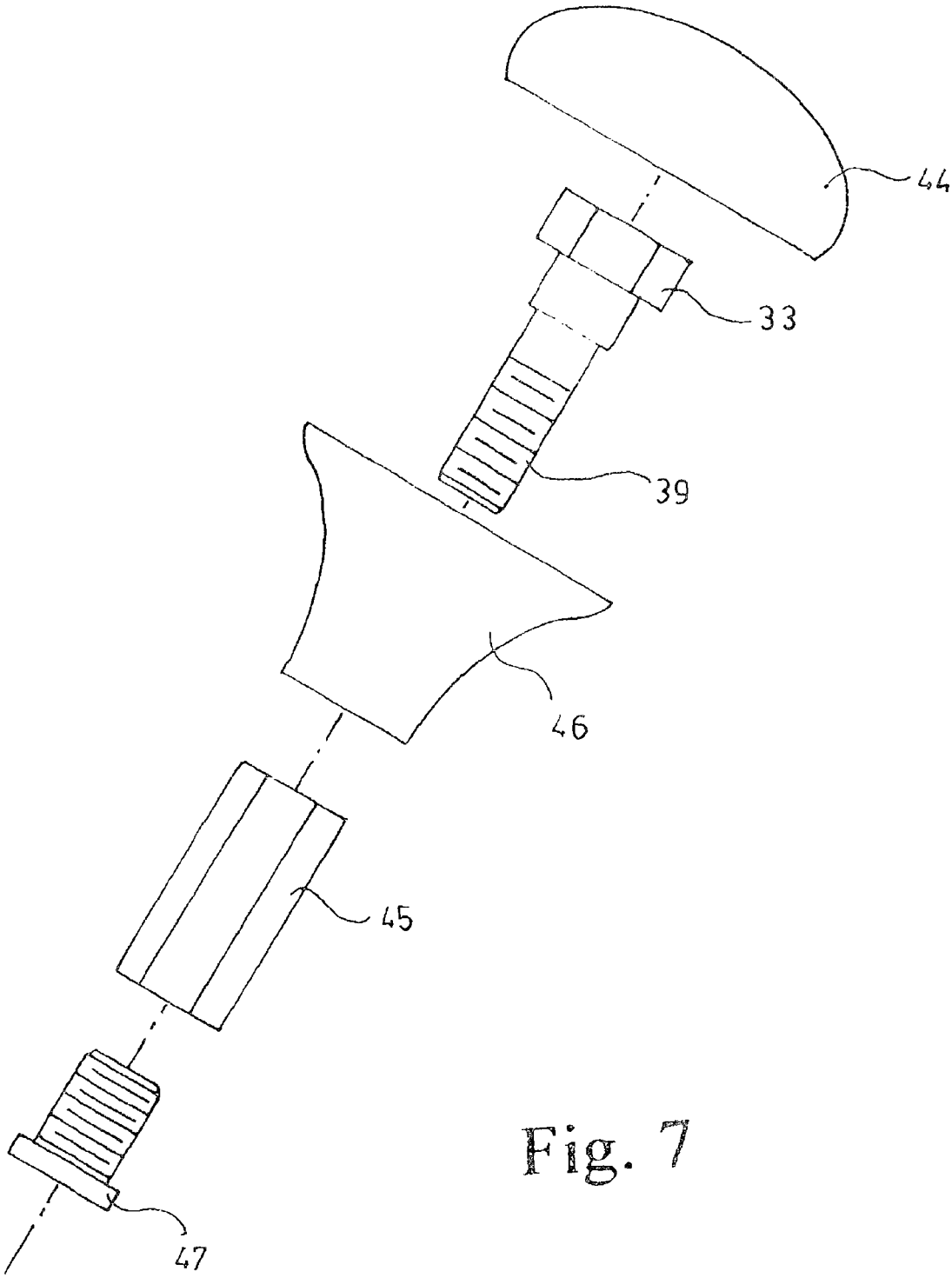
FIG. 7 is a disassembly diagram for another embodiment of the fastening button for the invention.
Figure 8:
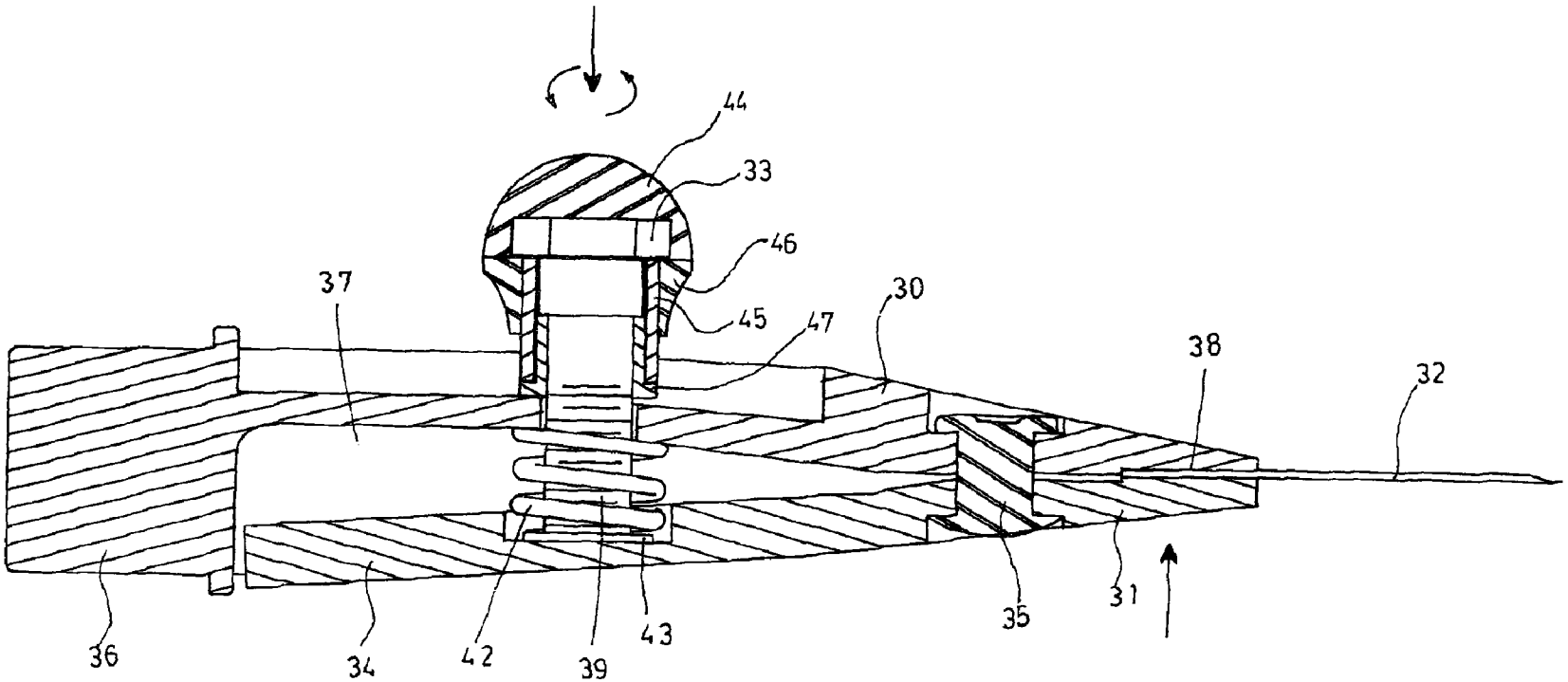
FIG. 8 is a cross-sectional diagram for the fastening button for another embodiment for the invention.

Please refer to FIGS. 7 and 8 for another preferred embodiment for the fastening button of the invention. The fastening button 33 has a molded knob 44 on its top, a sleeve 45 and a handle 46, which are integrated as one. An axle 47 connects in the bottom of the sleeve 45. The fastening button 33 goes into the sleeve 45 and leaves its threaded section 39 outside the axle 47. The fastening button 33 uses its threaded section 39 to attach to the jaw plate groove 37 of the scraping section 30 and is also sleeved with a spring 42 and a stopper 43. So it can provide fast replacement and firm assembly for the scraper blade 32. At this moment, the knob 44 and the handle 46 are combined to form a spherical fastening button 33. Besides, the relative movement between the handle 46 and the knob 44 does not affect the attachment. As a result, a user may exert a stronger force with hand grasping the front to achieve effective scraping and assure operation safety.

The above disclosed figures and description are only the preferred embodiments for the invention. The modifications or equivalent applications by people familiar with the arts, such as using a wedge or a cam to be the device that generates vertical pushing force for the fastening button in the jaw plate groove of the scraping section, are not outside the scope of the invention and shall be covered by the claims.

What is claimed is:

1. A scraper blade assembly structure, comprising:

a stem having a hand grip; and a scraping section disposed at a front of the stem, the scraping section including:

a first jaw plate having an arm that extends in a rearward direction;

a second jaw plate having a jaw plate groove that matches a shape of the first jaw plate, the first jaw plate being nested within the jaw plate groove, the second jaw plate being fastened to the first jaw plate using only two fasteners with the second jaw plate being pivotable relative to the first jaw plate, with the two fasteners serving as a pivot point, the jaw plate groove having a blade base at a front thereof;

a blade disposed at the blade base; and a fastening button, comprising:

a head, a shaft extending from the head, the shaft having a threaded section at an end thereof, the threaded section being threadably engaged with the second jaw plate in a region of the jaw plate groove, a spring sleeved over the threaded section and interposed between the second jaw plate and the arm of the first jaw plate, a stopper that is pressed between an end of the threaded section, and the arm of the first jaw plate, a molded knob disposed over the head, a handle disposed under the head, a sleeve that is sleeved over the shaft and that is received within the handle, the molded knob, handle and sleeve being integrated together to form a single component, and an axle that is received within a bottom of the sleeve, with the shaft extending through and projecting outside the axle;

wherein the spring urges the arm in a direction away from the jaw plate groove, so that a front of the first jaw plate is urged in a direction toward the blade base to grip the blade therebetween; and wherein as the threaded section is threaded into the second jaw plate, the end of the threaded section presses the stopper against the arm of the first jaw plate, causing the front of the first jaw plate to clamp the blade against the blade base.

2. The scraper blade assembly structure according to claim 1, wherein the fastening button is adapted to produce a vertical pushing force.

3. The scraper blade assembly structure according to claim 1, wherein the molded knob and the handle collectively form a sphere having the head received therein, and which protrudes above the second jaw plate.

* * * * *